US006202716B1

(12) United States Patent
Schwartz

(10) Patent No.: US 6,202,716 B1
(45) Date of Patent: Mar. 20, 2001

(54) REMOVING A DEVICE FOR LIQUID IN A FLEXIBLE PACKING AND A FLEXIBLE PACKING FOR ACCOMMODATING A LIQUID

(75) Inventor: Erhard Schwartz, Wiesloch (DE)

(73) Assignee: Deutsche Sisi-Werke GmbH & Co. Betriebs KG (DE)

( * ) Notice: Subject to any disclaimer, the term of this patent is extended or adjusted under 35 U.S.C. 154(b) by 0 days.

(21) Appl. No.: 09/275,684

(22) Filed: Mar. 24, 1999

(30) Foreign Application Priority Data

Apr. 30, 1998 (DE) ..... 198 19 574

(51) Int. Cl.[7] ..... B65B 1/04; B65B 3/00; B67C 3/00

(52) U.S. Cl. ..... 141/383; 141/329; 141/386; 222/80; 222/83.5; 229/103.5

(58) Field of Search ..... 141/311 R, 313, 141/314, 319, 323, 329, 330, 346, 369, 383, 386; 222/80, 81, 83, 83.5; 229/103.1; 220/90.2; 206/217; 239/33; 604/411, 412

(56) References Cited

U.S. PATENT DOCUMENTS

| | | | | |
|---|---|---|---|---|
| 2,849,321 | * | 8/1958 | Lhermitte et al. | 99/171 |
| 4,251,019 | | 2/1981 | Cone . | |
| 4,712,702 | | 12/1987 | Ayabe et al. . | |
| 4,911,315 | | 3/1990 | Shrum . | |
| 5,052,614 | | 10/1991 | Xuan . | |
| 5,462,194 | | 10/1995 | Barnwell . | |
| 5,513,762 | | 5/1996 | Janani . | |
| 5,526,853 | * | 6/1996 | McPhee et al. | 141/329 |
| 5,919,182 | * | 7/1999 | Avallone | 604/411 |

FOREIGN PATENT DOCUMENTS

| | | |
|---|---|---|
| 195 25 620A1 | 1/1997 | (DE) . |
| 296 13 177 U1 | 2/1997 | (DE) . |
| 2159123 | 11/1985 | (EP) . |
| 0 698 564 | 2/1996 | (EP) . |

OTHER PUBLICATIONS

English translation of Ahrens, DE 195 25 620.

* cited by examiner

*Primary Examiner*—Timothy L. Maust
(74) *Attorney, Agent, or Firm*—Tilton, Fallon, Lungmus & Chestnut

(57) ABSTRACT

A removing device for liquid in a flexible packing by means of which an unintentional escape of liquid and the ingress of air, dirt and microorganisms in the product accommodated in said packing can be prevented reliably and permanently. In order to achieve this, the removing device according to the present invention is provided with a tubular straw element including the inlet of the removing device and with a closure element associated with the outlet. The flexible packing according to the present invention, which is used for accommodating a liquid, is provided with an insertion area for inserting a removing device, said insertion area being defined by an opening formed in the envelope of said flexible packing and closed by a foil in the initial state, said foil being of such a nature that it will sealingly wrap itself around the introduced removing device thus forming a tentlike shape.

6 Claims, 4 Drawing Sheets

REMOVING A DEVICE FOR LIQUID IN A FLEXIBLE PACKING AND A FLEXIBLE PACKING FOR ACCOMMODATING A LIQUID

BACKGROUND

1. Field of the Invention

The present invention refers to a removing device for liquid in a flexible packing and to a flexible packing used for accommodating a liquid.

2. Description of the Related Art

Such a removing device is known e.g. as a drinking straw for removing beverages from a beverage bag.

The simplest form of a known drinking straw consists only of a tubular straw element produced from a plastic material that is unobjectionable from the point of view of the law relating to food production and distribution, said straw element being preferably produced by extrusion. The inlet of the known drinking straw is normally cut at an oblique angle to the longitudinal axis of the drinking straw so as to form an insertion tip penetrating through the beverage bag. The beverage bag into which the drinking straw can be inserted is provided with an insertion area. This insertion area is of such a nature that it permits easy penetration of the drinking straw. For this purpose, the flexible packing is normally provided with a circular opening in the insertion area, the diameter of said opening corresponding approximately to the outer diameter of the drinking straw. Prior to the first insertion of a drinking straw into the opening, said opening is closed by an interior foil covering said opening.

The foil is normally implemented as an interior foil and, consequently, secured to the inner side of the envelope, e.g. by a welded joint or an adhesive joint. The interior foil is e.g. a polyethylene foil. Alternatively, said interior foil may also consist of a composite foil. The flexible packing may consist of an arbitrary envelope material.

For example, flexible packings are known whose envelope consists of a single-layer or a multilayer foil. Alternatively, the envelope of the flexible packing may also comprise a paper or cardboard material which has beeen prepared—e.g. by providing a waterproof foil or coating on the inner side thereof—in such a way that the envelope is prevented from softening, thus guaranteeing that the liquid will be kept safely in said flexible packing.

When the drinking straw is being inserted into the beverage bag, it will penetrate through the interior foil so that the content of the bag will communicate with said drinking straw and so that the drinkable liquid can be sucked from the beverage bag through said drinking straw. The known drinking straw is, however, not fully sealed with regard to the beverage bag so that dirt or small insects may penetrate into said beverage bag. Moreover, the danger exists that microorganisms or oxygen may be introduced via the drinking straw into the product accommodated in the flexible packing. This will contaminate the product, e.g. reduce the keeping quality of the beverages. In addition, the drinkable liquid may escape through the drinking straw. Such an undesired escape of drinking liquid will especially occur if the internal pressure of the drinkable liquid in the beverage bag is increased unintentionally via the flexible envelope of the beverage bag.

BRIEF SUMMARY OF THE INVENTION

It is the object of the present invention to provide a removing device for liquid in a flexible packing by means of which the above-mentioned drawbacks are avoided. It is a special object of the present invention to provide a removing device for liquid in a flexible packing which permits said flexible packing to be sealed in such a way that an ingress of dirt into the product accommodated in said flexible packing as well as an unintentional escape of the product can be avoided, and which also permits easy removal of the liquid from the flexible packing.

It is a further object of the present invention to provide a flexible packing used for accommodating a liquid with the aid of which good sealing relative to the removing device can be achieved and which is particularly suitable for use with the removing device according to the present invention.

In order to achieve this object, the present invention suggests a removing device for liquid in a flexible packing, comprising a tubular straw element including the inlet of the removing device and further comprising a closure element associated with the outlet.

By means of the removing device according to the present invention, the liquid product accommodated in the flexible packing can be removed from said packing via the tubular straw element. An ingress of dirt and microorganisms as well as of air and an unintentional escape of liquid can easily be avoided by the closure element associated with the outlet. The removing device according to the present invention is suitable for use with a large number of flexible pakkings, e.g. as a removing device for cardboard packings, which are nowadays frequently used for packing pasteurized milk or fruit juices, or for the bag-shaped packings which have lately become more and more common as light-weight packings that can be disposed of without taking up much space, said bag-shaped packings being used especially for toilet articles and cleaning agents.

Any closure element that permits repeated opening and closing of the straw element can be used as a closure element. A screw top or a hinged top can, for example, be used. The person skilled in the art knows other closure means, especially the so-called push-pull top which is frequently used for closing beverage bottles.

According to an advantageous embodiment of the present invention, the closure element is formed integrally with the straw element, said closure element being formed on one end of said straw element as a cap that can be broken off. By breaking the cap off and by turning it, said cap can be attached to the free end of the straw element where it then serves as a closure element.

The straw element is preferably provided with an insertion tip on the inlet. Surprisingly enough, it turned out that this kind of removing device permits the removal of liquid from a flexible packing produced from a plastic foil or having an insertion area that consists of a plastic foil, the ingress of dirt, microorganisms and air being reliably and permanently avoidable at the same time. The plastic foil of the flexible packing or of the insertion area of said flexible packing elastically wraps itself around the circumferential surface of the straw element when said straw element is being inserted. This has the effect that the straw element is reliably sealed relative to the flexible packing. Since the removing device is also provided with a closure element by means of which the ingress of dirt, microorganisms and air can be prevented, the liquid can be kept stably for a certain period of time in the flexible packing without any deterioration of the product quality, with a removal of the liquid being permitted at the same time. For producing this effect, it is only necessary to use a straw element provided with an insertion tip at the inlet and having an outlet that is adapted to be closed by a closure element.

In order to save material, the straw element can be an extruded straw having a small wall thickness. For achieving the best possible sealing effect also in the case of this kind of straw element, it is suggested that, according to a further embodiment of the present invention, the closure element should be provided with a counterelement which is connected to the straw element.

The straw element is permanently fastened to the flexible packing in that the inlet and the outlet have provided between them a fastening means with the aid of which the straw element can be connected to the flexible packing. The fastening means can consist of an adhesive layer applied directly to the straw element. For providing a connection between the removing device and the flexible packing, this adhesive layer can be provided on the envelope of the flexible packing or on adhesive tabs secured to the envelope of said flexible packing. Alternatively, adhesive strips may be provided between the outlet and the inlet of the straw element, said adhesive strips having one end secured to the straw element whereas the other end thereof is provided with an adhesive layer used for fastening said strips to the flexible packing. It is also possible to implement the fastening means as a snap-in connection. Such a snap-in connection can be used for fixing e.g. the envelope material of the flexible packing or snap-in means which are secured to the envelope of the flexible packing. The removing device can be fixedly connected to the flexible packing with the aid of the above-mentioned fastening means.

Preferably, the fastening means consists of a locking element which is sealed from the straw element. By means of said locking element, a positive connection is provided between the flexible packing and a removing device inserted in said flexible packing. This positive engagement results in a reliable connection between the flexible packing and the removing device according to the present invention so that unintentional drawing out of the removing device from the flexible packing can be avoided.

According to a preferred embodiment, it is suggested that the locking element should be provided with a sleeve, the straw element being fitted into said sleeve. Such a sleeve can be formed integrally with the removing device. It is, however, also possible to produce the sleeve separately from the straw element so that the advantages according to the present invention can be achieved by means of a simple extruded straw element which is inserted into the sleeve and the outlet of which is closed by means of an arbitrary closure element.

For achieving simplifications with respect to production engineering, the present invention is further developed in that the sleeve is formed integrally with the counterelement. In accordance with a further preferred embodiment, it is suggested according to the present invention that locking fingers should extend in the axial direction of the sleeve, the free ends of said locking fingers having arranged thereon locking projections which taper towards the the inlet. The locking projections define sliding surfaces along which the envelope material of the flexible packing slides when the removing device is being inserted into the flexible packing. This has the effect that the locking fingers are forced radially inwards. When the locking projections have penetrated the envelope, they will recoil radially outwards due to the elasticity of the locking fingers so that they will abut on the inner surface of the envelope in positive engagement therewith. When the flexible packing has been emptied, the locking fingers can be pressed together by the user's fingers from outside so that the removing device according to the present invention can easily be removed from the flexible packing together with the sleeve. Such a separation of the storage receptacle and of the removing device can be desirable for reducing the waste volume or for accurate waste separation according to individual materials or in order to permit the removing device to be reused.

In the case of an alternative embodiment, which also provides an efficient connection between the removing device and the flexible packing, the locking element has a frusto-conical outer surface which tapers towards the inlet and which is preferably interrupted in the circumferential direction. When the removing device is being inserted into the flexible packing, the outer surface will here again act as a sliding surface causing the envelope material of the packing to stretch elastically. When the outer surface is interrupted in the circumferential direction, the individual circular segments can be forced radially inwards independently of one another so as to reduce the elastic strain of the envelope material, and, when the locking element has penetrated the envelope material, said circular segments can recoil radially outwards and abut on the inner side of the envelope in positive engagement therewith so as to prevent the removing device from being drawn out unintentionally.

The present invention additionally suggests that a stop extending essentially at right angles to the longitudinal axis of the straw element should be provided between the locking element and the outlet. This stop prevents the straw element from penetrating deeper into the flexible packing than has been intended. The stop and the locking element can be formed as an integral component so that said locking element and said stop can easily be produced together in an injection moulding process.

The stop is formed by a ring in a simple manner. This ring can be held on the sleeve or on the outer surface of the straw element itself in positive or in frictional engagement therewith. If the stop is formed on a ring which is held on the circumferential surface of the sleeve or of the straw element in frictional engagement therewith, it will be possible to displace said ring axially towards the inlet, when the removing device has been inserted, so as to fix the envelope of the flexible packing between the locking element and the stop on the removing device. If, in accordance with an alternative embodiment, the stop is formed on a ring which is held on the sleeve or on the outer surface of the straw element in positive engagment therewith, e.g. via a simple plastic thread, this ring can be tensioned towards the inlet of the removing device when the removing device has been inserted. In this way, it is again possible to fix the envelope of the flexible packing between the locking element and the stop. The fixing of the envelope of the flexible packing has the effect that the removing device according to the present invention is held on the flexible packing, e.g. on a beverage bag, such that it is secured against rotation relative thereto. This can be desirable especially in cases where a screw top is used as a closure element.

The removing device can also be secured against rotation by means of other structural designs. The removing device can, for example, have a cross-sectional shape which differs from a rotationally symmetric cross-sectional shape in the insertion area. This cross-sectional shape can, for example, be square or elliptical. In addition, it is possible to provide a component which is fixedly connected to the flexible packing and which is engaged by the removing device inserted in said flexible packing, whereby said removing device will be held such that it is secured against rotation. This component can, for example, be a plastic ring which is welded to the envelope and which is provided with locking projections on the side directed towards the interior of the bag, said locking projections being engaged by complementary mating parts of a removing device to be inserted so that a rotational displacement is again effectively prevented.

A removing device which is easy to produce from the point of view of production engineering is obtained when the counterelement as well as the stop and the locking element are formed as an integral component. Such a component can be produced as an injection moulded part separately from a smooth extruded straw element. The straw element and the component comprising the counterelement, the stop and the locking element can be joined in a subsequent production step by means of an adhesive or by welding. When the stop and the locking element are formed on a sleeve, it is also possible to finish the removing device according to the present invention simply by inserting the extruded straw element into the sleeve or by pressing it into said sleeve, provided that the outer diameter of the straw element and the inner diameter of the sleeve are dimensioned such that both parts will be sealed from one another.

According to another preferred embodiment of the present invention, the closure element is adapted to be moved in the longitudinal direction of the straw element between a first position at which the outlet is closed by said closure element and a second position at which the outlet is open. The movability of the closure element in the longitudinal direction guarantees that said closure element can easily be actuated, if necessary also by the user's mouth. Such an actuation of the closure element is imaginable especially when the removing device according to the present invention is used in the field of sports, e.g. during cycling.

For reliably holding the closure element either at the first position at which the outlet is closed or at a second position at which the outlet is fully open, the counterelement is preferably provided with two stops delimiting the movement of the closure element. In order to prevent an unintentional displacement of the closure element from its first, closing position, said closure element may be in threaded engagement with the counterelement at least at this first position.

For achieving the above-mentioned object with respect to the flexible packing, the flexible packing is further developed in accordance with the present invention in such a way that the foil will be of such a nature that it will sealingly wrap itself around the introduced removing device thus forming a tentlike shape. Normally, a sealing contact between the foil and the removing device is caused by elastic strain elements in the foil in the area of insertion of said removing device. For forming a substantially tentlike shape of the foil, when the foil is being penetrated by the removing device, said foil is secured to the envelope at a sufficiently large distance from the insertion area. Since the opening in the envelope preferably has a diameter that corresponds to the outer diameter of the removing device in the insertion area, also the point of fastening between the foil and the envelope is located at a sufficiently large distance from the opening.

Preferably, the foil has formed therein at least one fold in its initial state, i.e. before the removing device is introduced in the flexible packing. This fold has the effect that, in its initial state, the foil tightly covers the opening and that, even if the foil stretches only very little, it will wrap itself in a tentlike shape around the removing device introduced in the flexible packing.

A preferred embodiment of the present invention discloses that, in the initial state, overlapping pieces of the foil are connected to one another in the area of the fold so that the opening will be covered tightly. Alternatively or additionally, the foil is connected to the envelope in order to achieve this. The connection guarantees that the foil will tightly cover the opening in its initial state so that no dirt, bacteria or the like will penetrate into an intermediate area between the foil and the envelope. The connection of the foil to the envelope or of one foil layer to the next is releasably implemented in such a way that, when the removing device is being introduced, said connection will be released so that the foil will bulge around the removing device in the desired tentlike shape.

Preferably, the foil has an elongate shape, the folds extending in the longitudinal direction of the foil. This configuration will support bulging of the foil in a tentlike shape when the removing device is being introduced in the flexible packing.

In accordance with an alternative suggestion, the foil consists of an elastic material so as to cover the opening tightly, the connection between said foil and the envelope extending, with respect to the elastic properties of the foil, in such a way that the foil sealingly wraps itself around the inserted removing device thus forming a tentlike shape. When a foil is chosen that stretches well, the location of connection between the foil and the envelope can therefore be arranged at a small distance from the opening, whereas a foil which stretches only very little will be connected to the envelope in such a way that the location of connection, e.g. the weld, is comparatively remote from the insertion hole. Quite generally, it can be said that the better the foil stretches, the smaller the distance between the opening and the point of connection between the foil and the envelope can be.

Further details, advantages and features of the present invention can be seen from the enclosed drawing of four embodiments, in which:

DETAILED DESCRIPTION OF THE INVENTION

Figure 1:
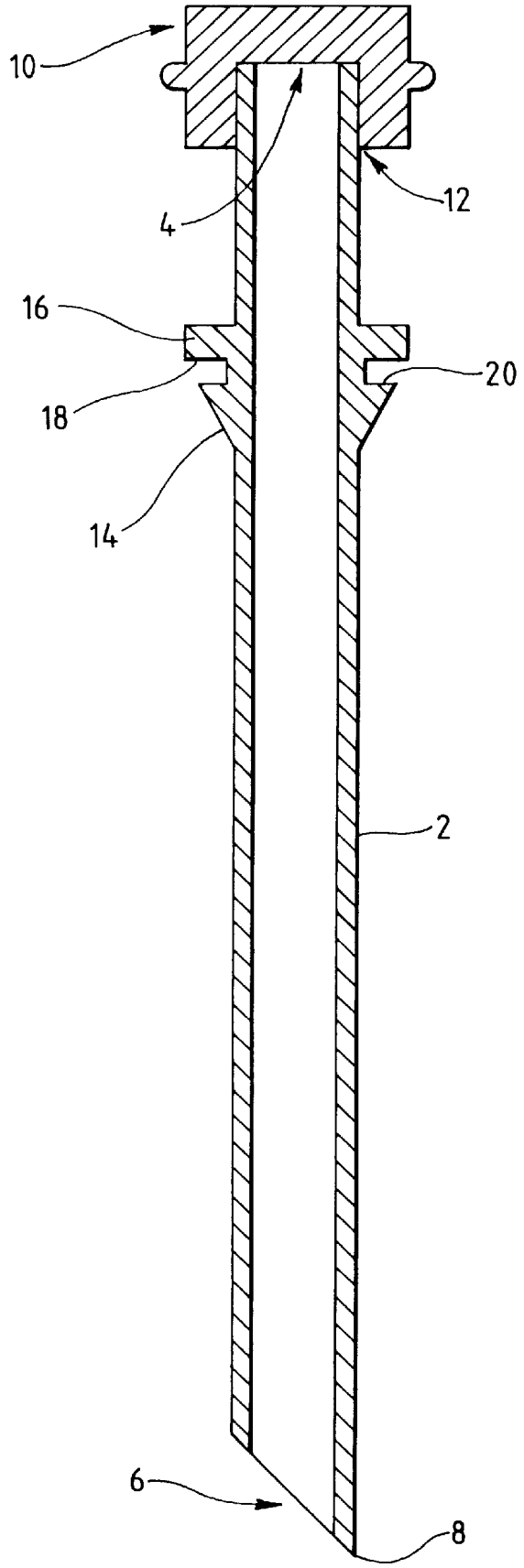
FIG. 1 shows a longitudinal section through a first embodiment of a removing device according to the present invention.

The embodiment of a removing device according to the present invention shown in FIG. 1 is a drinking straw. This drinking straw comprises a cylindrical straw element 2 as a straw element having an outlet which is referred to as mouth end 4 and an outlet located opposite to said mouth end 4 and referred to as bag end 6. The bag end 6 of the straw element 2 is cut at an oblique angle to the longitudinal axis of the straw element 2, whereby an insertion tip 8 is formed.

A closure cap 10 is provided on the mouth end 4 as a closure element. In the representation shown, the straw element 2 is closed by the closure cap 10, the inner surface of a recess 12 formed in said closure cap 10 being in contact with the outer surface of the straw element 2.

The drinking straw shown is provided with a locking element 14 which is located between the mouth end 4 and the bag end 6 and which is formed by a truncated cone tapering conically towards the bag end. A ring 16 is arranged between the mouth end 4 and the locking element 14, the annular surface of said ring 16 facing the bag end 6 defining a stop 18.

The distance between the stop 18 and an annular surface 20 of the locking element 14 facing the mouth end 4 is dimensioned such that an envelope of a beverage bag, which is not shown, can be received between said stop 18 and said annular surface 20.

Figure 7:
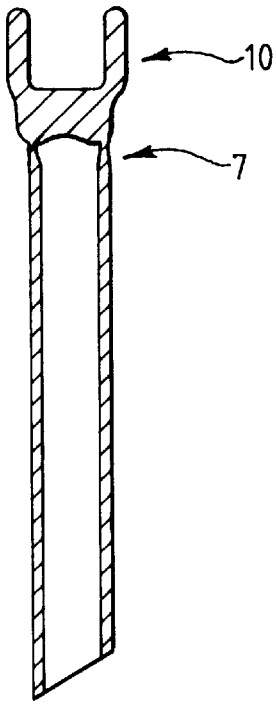
FIG. 7 shows a further embodiment of a removing device according to the present invention.

The drinking straw shown in FIG. 1 is a plastic component which has been formed in one piece in an injection moulding process. The injection mould is shaped such that the closure cap 10 is connected to the ring 16 via a connecting bridge which is not shown. This connecting bridge, which is not shown, is sufficiently elastic so that the closure cap 10 can easily be removed from the mouth end 4 of the straw element 2. The closure cap can also be formed integrally with the mouth end of the straw element in the production process; this is schematically outlined in FIG. 7. By means of a portion of reduced thickness of the material, a break-off point 7 is formed so that the closure cap 10 can be broken off and, after turning, be put over the mouth end.

Figure 2:
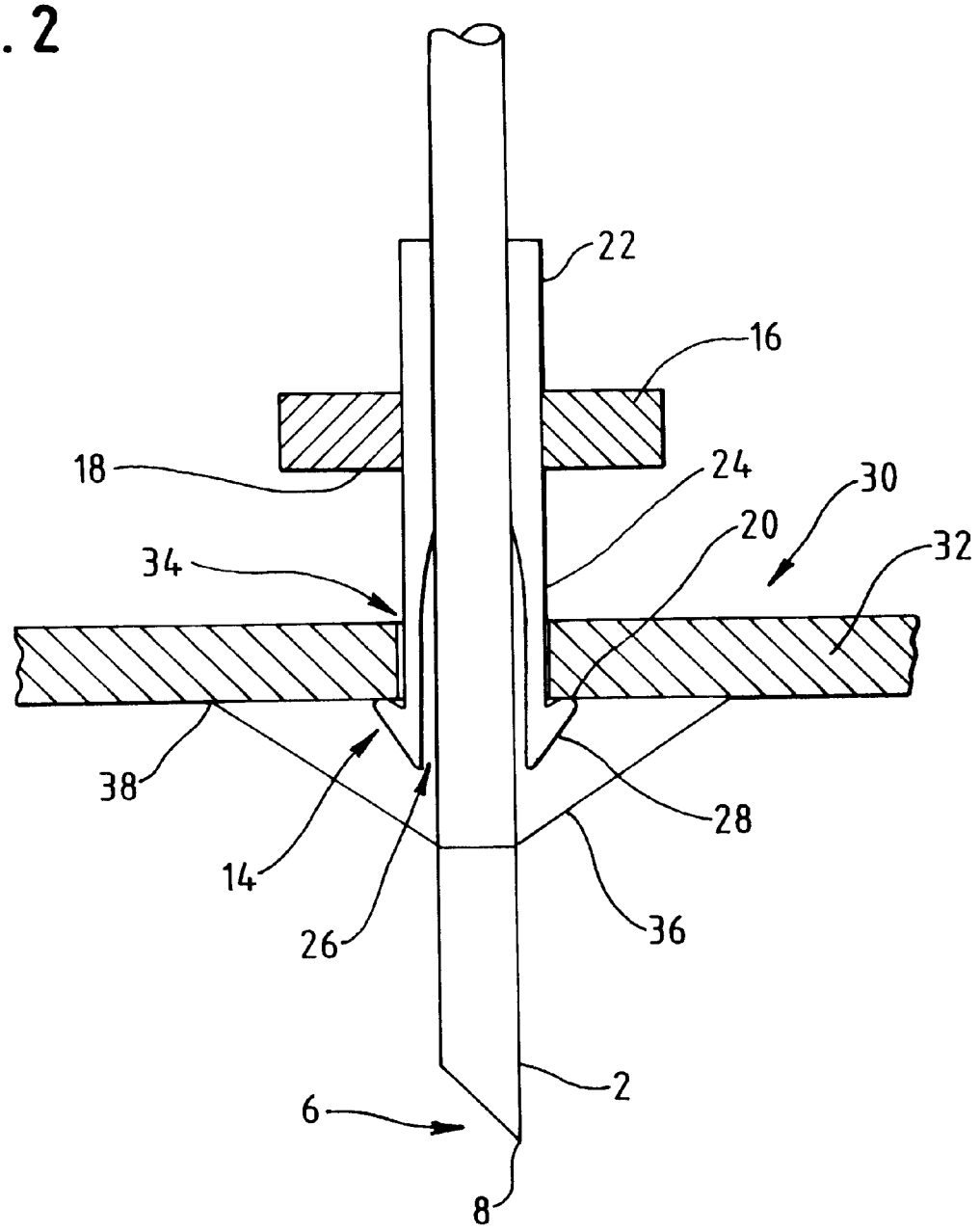
FIG. 2 shows an enlarged sectional view of part of a second embodiment of a removing device according to the present invention, said removing device being inserted in an insertion area of a wall of a flexible packing, e.g. a beverage bag.

FIG. 2 shows an enlarged sectional view of a part of a second embodiment of a liquid-removing device according to the present invention, said liquid-removing device being inserted in a flexible packing. Also this embodiment is a drinking straw, which is inserted in a beverage bag in the representation according to FIG. 2. In comparison with the representation according to FIG. 1, identical components are designated by identical reference numerals.

The straw element 2 of the embodiment shown is accommodated in a sleeve 22 which is provided with locking fingers 24 on its front end facing the bag end 6. The locking fingers 24 extend axially from a front end of the sleeve 22 facing the bag end 6. In the embodiment shown, a plurality of locking fingers 24 is distributed over the front end of the sleeve 22, said locking fingers 24 being separated from one another. The wall thickness of the locking fingers 24 is smaller than the wall thickness of the sleeve 22 so that an annular gap 26 is formed between said locking fingers 24 and the straw element 2. Each locking finger 24 is provided with a locking projection 28 on the end facing the bag end 6. In the sectional view shown, the triangular cross-sectional area of the locking projections 28, which taper towards the bag end 6, can be seen clearly.

In addition, a ring 16 is secured to the outer surface of the sleeve 22 between the locking projections 28 and the mouth end of the straw element 2, said mouth end being not shown. This ring 16 extends at right angles to the axis of the straw element 2 and forms the stop 18 at its annular surface facing the bag end 6.

The representation according to FIG. 2 shows the drinking straw at a position at which it is located when it has been inserted into a beverage bag 30. The beverage bag 30 consists essentially of an envelope 32 provided with an opening 34 in the insertion area. The opening 34 is closed by an interior foil 36 before a drinking straw is inserted. Said interior foil 36 is provided at least in the insertion area of the beverage bag where it is welded via an annular weld 38 to the inner side of the envelope 32 in spaced relationship with the opening 34.

When the drinking straw shown in FIG. 2 is being inserted, the insertion tip 8 first penetrates through the interior foil 36. Said interior foil 36, which is produced e.g. from polyethylene, is of such a nature that, when penetrated by the bag end 6 of the straw element 2, it will stretch and elastically wrap itself around the circumferential surface of the straw element 2. This provides an effective sealing between the interior foil 36 and the straw element 2. Due to the holding forces between the interior foil 36 and the straw element 2, said interior foil 36 will bulge towards the interior of the beverage bag 30 when the drinking straw is being inserted into said beverage bag 30 and slide along the circumferential surface of the straw element 2 when said drinking straw 2 is being inserted. In the course of this process, the interior foil 36 stretches elastically so that it assumes a tentlike shape.

When the drinking straw is advanced still further, the conical outer surfaces of the locking projections 28 will finally strike against the outer edge of the opening 34 and slip on said outer edge. Hence, the locking projections 28 will be forced inwards into the annular gap 26, whereby the lokking fingers 24 will be caused to stretch elastically. When the locking projections 28 have slidingly passed the inner sufaces of the opening 34 and penetrated the envelope 32, the locking projections 28 will resume their former position due to the elastic strain of the locking fingers 24. The locking projection surfaces facing the mouth end then abut on the inner surface of the envelope 32 via an annular surface 20. This positive engagement prevents the drinking straw from being unintentionally removed from the beverage bag 30. This connection is improved still further by the fact that the outer circumferential surface of the locking fingers 24 abuts on the inner surface of the opening 34.

Excessive insertion of the drinking straw into the beverage bag 30 is prevented by the ring 16, the stop 18 of which strikes against the outer surface of the envelope 32 as the drinking straw penetrates more and more into the beverage bag 30. As soon as the user notices this resistance, he can withdraw the inserted drinking straw from the beverage bag in the opposite direction so as to achieve the preferred surface contact between the locking projections 28 and the envelope 32.

It can be seen from the above description that, when the drinking straw has been inserted into the beverage bag 30, unintentional withdrawal of the drinking straw from the beverage bag 30 is prevented by the positive engagement of the surfaces of the locking element 14 facing the mouth end 4. An undesired escape of liquid from the beverage bag is, on the one hand, prevented by the interior foil 36 which is in sealing contact with the straw element 2. Hence, the beverage bag 30 is reliably sealed with regard to the drinking straw. Since the mouth end of the drinking straw is, on the other hand, adapted to be closed by an arbitrary closure element, the passage created by the straw element 2 and leading to the drinkable liquid contained in the beverage bag 30 can be closed. Hence, dirt is prevented from penetrating into the beverage bag 30 and an unintentional escape of the drinkable liquid from the beverage bag is avoided. Due to the stop 18, the drinking straw cannot penetrate into the beverage bag 30 too far. In an ideal case, the distance between the annular surface 20 of the locking element 14 facing the mouth end and the stop 18 is chosen such that, when the drinking straw is moved back and forth between these two surfaces, the interior foil 36, which is in sealing contact with the straw element 2, will not be displaced relative to said straw element 2. By means of this measure, a reliable sealing between the straw element 2 and the interior foil 36 is achieved until the beverage bag has been emptied completely.

The embodiments of drinking straws according to the present invention, which are shown in FIGS. 1 and 2, can be removed easily by drawing the drinking straw out of the beverage bag 30. Although the elasticity of the material of the envelope 32 provides a sufficient resistance when the locking element 14 is in surface contact with the envelope 32 so that an unintentional removal of the drinking straw from the beverage bag 30 is prevented, it is, due to the elastic properties of the material of the envelope 32, possible to remove the drinking straw from the beverage bag, when said beverage bag has been emptied. In the case of the drinking straw shown in FIG. 2, the user can also seize the locking fingers 24 from outside with his fingers and force them radially inwards into the annular gap 26 so that the positive engagement between the locking projections 28 and the envelope 32 will be eliminated and the drinking straw can be drawn out of the beverage bag 30 in a simple manner. Only the friction between the straw element 2 and the interior foil 36 offers a certain, small amount of resistance to this movement of the drinking straw out of the beverage bag 30.

Figure 3:
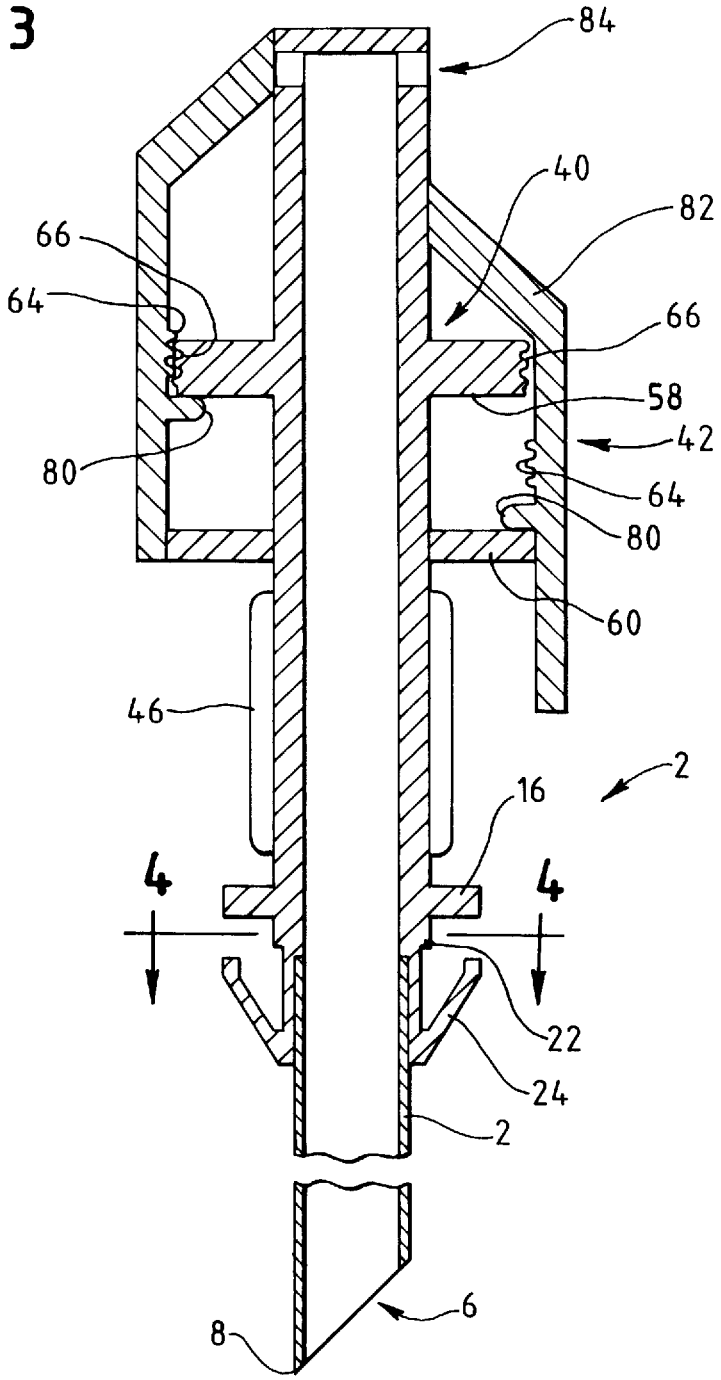
FIG. 3 shows a sectional view of a third embodiment of a removing device according to the present invention, the left half showing the closure element at the closed position and the right half showing the closure element at the open position.
Figure 4:
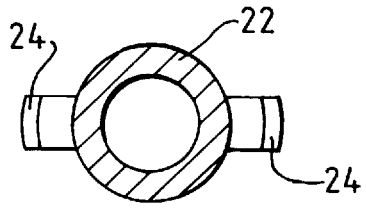
FIG. 4 shows a cross-sectional view along line IV—IV according to the representation in FIG. 3.

FIGS. 3 and 4 shows a further embodiment of the removing device according to the present invention, and this embodiment is also a drinking straw. In comparison with FIGS. 1 and 2, identical components are therefore again designated by identical reference numerals.

The embodiment shown in FIGS. 3 and 4 is a drinking straw consisting essentially of three pieces, said drinking straw comprising a straw element 2 having an inlet which is referred to as bag end 6, a counterelement 40 secured to the straw element 2, and a closure element 42. The straw element 2 is fitted into a sleeve 22 which is formed integrally together with the counterelement 40 as an injection-moulded part. The sleeve 22 has two locking fingers 24 on the end facing the bag end 6. As can be seen from FIGS. 3 and 4, the locking fingers 24 are formed by two segments of a truncated cone tapering towards the inlet 6, said segments being interrupted in the circumferential direction. As can especially be seen from the representation in FIG. 4, two such locking fingers 24 are arranged on the circumference of the sleeve 22.

The locking fingers 24 and the counterelement 40 have first provided between them a ring 16 which is arranged adjacent the locking fingers 24. Axially extending grip strips 46 are arranged between the ring 16 and the counterelement 40, said grip strips 46 being circumferentially distributed on said counterelement and causing an expansion of diameter so that the removing device can easily be held between ones fingers even if the straw element 2 has a small diameter, e.g. a diameter of less than 1 cm.

The counterelement 40 has provided thereon two spaced stop rings 58, 60 which are formed integrally therewith. The stop ring 58 facing the mouth end 4 has on its circumferential surface an external thread 66 cooperating at the closed position of the closure element 42 with an internal thread 64 formed on the inner surface of said closure element 42 so as to secure the closure element 42 in position on the counterelement 40 and so as to prevent an unintentional axial displacement of said closure element 42.

Between the two stop rings 58, 60 an annular bead 80 is arranged, which is formed on the inner side of the closure element 42, said annular bead 80 abutting on the stop ring 58 facing the mouth end 4 for securing the closure element 42 in position at the closed position shown in the left half of FIG. 3, and on the other stop ring 60 at an open position shown in the right half of FIG. 3. Starting from a cylindrical shape, the closure element 42 extends in a roof shaped configuration at an oblique angle inwards in its area facing the mouth end 4, whereby a truncated cone 82 is formed. At the closed position of the closure element 42, the inner circumferential surface of the truncated cone 82 abuts on outlets 84, which are formed on the counterelement 40, in the area of the mouth end 4. At the open position of the closure element 42 shown in the right half of FIG. 3, the outlets 84 formed on the circumferential surface of the counterelement 40 are free.

Figure 5:
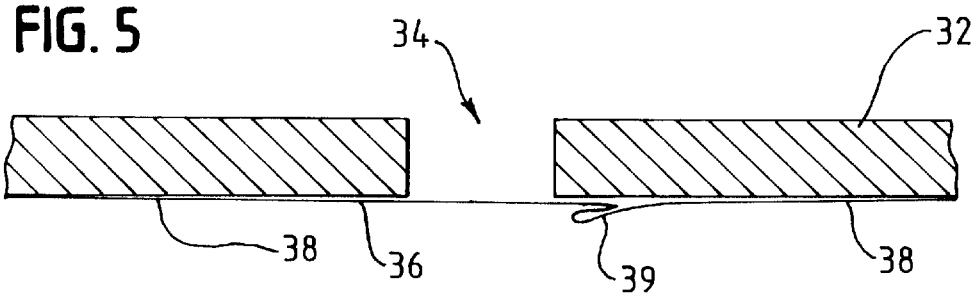
FIG. 5 shows a longitudinal sectional view of a second embodiment of a flexible packing according to the present invention.
Figure 6:
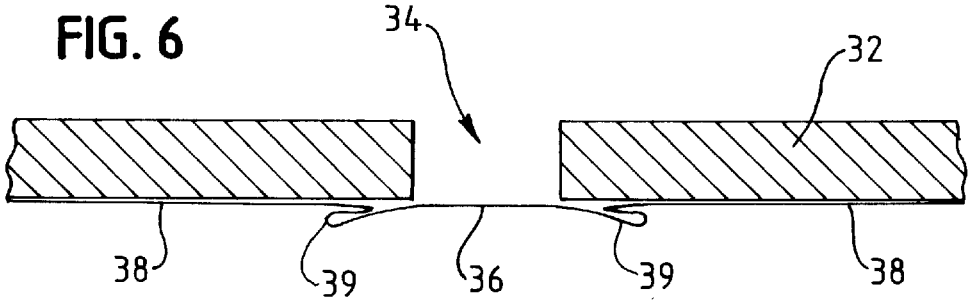
FIG. 6 shows shows a longitudinal sectional view of a third embodiment of a flexible packing according to the present invention.

FIGS. 5 and 6 show longitudinal sectional views of an insertion area of a second and of a third embodiment of a flexible packing according to the present invention. An envelope, which can consist of a coated cardboard or a foil-covered cardboard, a composite foil or a foil consisting of a single material, is provided with an opening 34. On the inner side of the packing, i.e. on the inner side of the envelope 32, an interior foil 36 is connected to the envelope 32 via a weld 38. In the case of the embodiment shown, the interior foil 36 has a rectangular, elongate base area.

In the embodiment shown in FIG. 5, the interior foil 36 forms a fold 39 on one side of the opening 34, whereas in the case of the embodiment shown in FIG. 6 a respective fold 39 is provided on either side of the opening 34.

In the initial state, i.e. before the removing device is introduced in the flexible packing, the interior foil 36 is sealed into the interior of the flexible packing, i.e. said interior foil 36 is stretched tightly over the opening 34. In the embodiment shown in FIG. 5, the part of the interior foil 36 extending away from the opening is connected to the envelope 32 in the area of the fold 39, said connection being of such a nature that it will separate when the removing device is being introduced in the introduction area so that the interior foil 36 will bulge in a tentlike shape around the introduced removing device thus sealing the outer surface of the removing device.

For reasons of symmetry, the embodiment shown in FIG. 6, which is provided with a respective fold 39 on either side of the opening 34, should be preferred. In the embodiment shown in FIG. 6, the portion of the interior foil 36 extending away from the opening 34 is releasably connected to the material of the interior foil 36 in the area of the respective fold 39 so as to obtain a tight cover for the opening 34. It should be taken into account that the representation according to FIG. 6 does not correspond to the actual circumstances, since the individual fold segments are spaced from one another for reasons of representation so that in said representation the opening 34 is not shown in a condition in which it is tightly covered by the interior foil 36.

When the removing device is being inserted, the piercing tip 8 penetrates through the interior foil 36; due to the properties of its material, said interior foil 36 will not tear, but wrap itself elastically around the circumferential surface of the straw element 2. When the removing device is advanced still further, the interior foil 36 will be entrained in the direction of insertion so that the sealed-in fold(s) will unfold. The interior foil 36 follows the insertion movement of the removing device and bulges in a tentlike shape on either side of the straw element 2 between the straw element 2 and the welds 38. This will have the effect that a free space, which is required for accommodating the locking element (s), is created between the interior foil 36 and the envelope 32. The locking elements 20, 24 penetrate into this free space where they abut on the inner side of the envelope 32 in positive engagement therewith.

What is claimed is:

1. A removing device for liquid in a flexible packing comprising a tubular straw element including an inlet and an outlet of the removing device, wherein the tubular straw element includes a closure element associated with the outlet, said closure element having associated therewith a counterelement which is connected to said straw element, wherein said inlet and said outlet have provided between them a fastening means with the aid of which said straw element can be connected to the flexible packing, said fastening means being defined by a locking element which is sealed from said straw element and the locking element is provided with a sleeve, said straw element being fitted into said sleeve, and wherein said sleeve is connected to said counterelement such that they form an integral component.

2. A removing device for liquid in a flexible packing comprising a tubular straw element including an inlet and an outlet of the removing device, wherein the tubular straw element includes a closure element associated with the outlet, said closure element having associated therewith a counterelement which is connected to said straw element, wherein said closure element is adapted to be moved in the longitudinal direction of said straw element between a first position at which said outlet is closed by said closure element and a second position at which said outlet is open, and wherein said counterelement is provided with two stops delimiting the movement of said closure element.

3. A removing device for liquid in a flexible packing comprising a tubular straw element including an inlet and an outlet of the removing device, wherein the tubular straw element includes a closure element associated with the outlet, said closure element having associated therewith a counterelement which is connected to said straw element, wherein said closure element is adapted to be moved in the longitudinal direction of said straw element between a first position at which said outlet is closed by said closure element and a second position at which said outlet is open, and wherein at least at said first position, said closure element is in threaded engagement with said counterelement.

4. A removing device according to claim 3, wherein said closure element is produced such that it is formed integrally with said straw element and connected thereto via a break-off point.

5. A device for removing liquid from a flexible packaging comprising a generally tubular straw element having an inlet and an outlet, a removable closure selectively engageable directly with said outlet of the straw element, and a locking element intermediate said inlet and outlet, said locking element tapering inwardly towards the inlet, and wherein said locking element is an axial extension of said generally tubular straw element.

6. The device of claim 5, further including a ring located between said locking element and said outlet, said ring having an annular surface providing a stop to prevent insertion of the device in said flexible packaging past said annular surface.

* * * * *